US008583347B2

(12) United States Patent
Veit et al.

(10) Patent No.: US 8,583,347 B2
(45) Date of Patent: Nov. 12, 2013

(54) METHOD FOR DETERMINING AT LEAST ONE RAIL PRESSURE/CLOSING CURRENT VALUE PAIR FOR A PRESSURE CONTROL VALVE OF A COMMON RAIL INJECTION SYSTEM

(75) Inventors: Guenter Veit, Plochingen (DE); Thomas Breitbach, Backnang (DE)

(73) Assignee: Robert Bosch GmbH, Stuttgart (DE)

( * ) Notice: Subject to any disclaimer, the term of this patent is extended or adjusted under 35 U.S.C. 154(b) by 413 days.

(21) Appl. No.: 12/925,066

(22) Filed: Oct. 12, 2010

(65) Prior Publication Data

US 2011/0093183 A1 Apr. 21, 2011

(30) Foreign Application Priority Data

Oct. 12, 2009 (DE) ..... 10 2009 045 563

(51) Int. Cl.
*F02D 41/00* (2006.01)

(52) U.S. Cl.
USPC ..... 701/103

(58) Field of Classification Search
USPC ..... 123/454, 455, 456, 457; 701/101, 102, 701/103, 114, 115
See application file for complete search history.

(56) References Cited

U.S. PATENT DOCUMENTS

| | | | | |
|---|---|---|---|---|
| 6,912,983 | B2 * | 7/2005 | Okamoto et al. | 123/179.16 |
| 6,966,300 | B2 * | 11/2005 | Fukuda | 123/446 |
| 2005/0087174 | A1 * | 4/2005 | Veit | 123/456 |
| 2005/0092301 | A1 * | 5/2005 | Fukuda | 123/446 |
| 2008/0281500 | A1 * | 11/2008 | Nakata et al. | 701/103 |

FOREIGN PATENT DOCUMENTS

GB 2378773 A * 2/2003

* cited by examiner

*Primary Examiner* — Stephen K Cronin
*Assistant Examiner* — Elizabeth Hadley
(74) *Attorney, Agent, or Firm* — Kenyon & Kenyon LLP

(57) ABSTRACT

A method for determining at least one rail pressure/closing current value pair for a pressure control valve of a common rail injection system of an internal combustion engine includes the following steps: operating the common rail injection system in an MU control mode; reducing the control current for the pressure control valve; detecting the pressure curve over time in the common rail and determining the rail pressure; determining the closing current based on the detected pressure curve; and associating the determined rail pressure and the determined closing current with a rail pressure/closing current value pair.

11 Claims, 3 Drawing Sheets

METHOD FOR DETERMINING AT LEAST ONE RAIL PRESSURE/CLOSING CURRENT VALUE PAIR FOR A PRESSURE CONTROL VALVE OF A COMMON RAIL INJECTION SYSTEM

BACKGROUND OF THE INVENTION

1. Field of the Invention

The present invention relates to a method for determining at least one rail pressure/closing current value pair for a pressure control valve of a common rail injection system.

2. Description of the Related Art

Common rail systems (CRS) for fuel injection are widely used at the present time in diesel engines. Modern common rail systems are frequently equipped with a so-called dual-actuator rail pressure regulator. In such a system, the injection pressure is set either by throttling the high-pressure pump via a valve (metering unit (MU)) situated upstream from the pump, or via a valve (pressure control valve (PCV)) situated on the high pressure side. Thus, in principle, the rail pressure may be regulated in such a system via three different operating modes (MU, PCV, and mixed operation). This is used in particular for diesel vehicles, for example on the one hand to introduce heat into the fuel system immediately after a cold start during cold weather (PCV operation with high power loss) and thus to minimize the risk of paraffination, and on the other hand to minimize the power loss during warm-weather operation by compressing only the fuel mass that is actually needed (MU mode). Switching between the two types of control modes requires accurate knowledge of the characteristic curves of both valves so that overshooting or undershooting of the pressure may be minimized. Namely, in particular for the pressure control valve, the closing current is a function of the prevailing rail pressure. In the following discussion, "characteristic curve" is understood as a number of rail pressure/closing current value pairs, i.e., the associated closing current of the valve at a given prevailing rail pressure.

The PCV characteristic curve is preferably adapted using a functionality known as the adaptive pressure control valve (APCV). For this purpose, in PCV mode when (quasi)-steady-state operating conditions are present, the actual current necessary for setting the desired rail pressure is measured, and is compared to an expected setpoint current. The ratio of the two currents is then stored as a learning value or adaptation value. To achieve high accuracy in the adaptation, this learning process should be applied at the highest possible operating pressures.

However, in many cases these required operating pressures are reached only at very high engine loads. In addition, due to environmental considerations, operation strictly in PCV mode should be avoided to the greatest extent possible. As a result of both of these factors, APCV adaptation occurs only infrequently. Furthermore, regulatory standards in many countries require more frequent determination of a PCV characteristic curve, i.e., one or multiple rail pressure/closing current value pairs.

It is therefore desirable to provide an adaptation method for a pressure control valve, having an increased learning frequency.

BRIEF SUMMARY OF THE INVENTION

According to the present invention, a method is proposed for determining at least one rail pressure/closing current value pair for a pressure control valve of a common rail injection system of an internal combustion engine. The present invention is applicable to diesel as well as spark ignition engines.

The present invention is essentially based on the knowledge that during an MU control mode of the common rail injection system, the closing current of the pressure control valve may be determined as a function of the prevailing pressure when the applied closing current is reduced until a change in the rail pressure is measurable. The closing current determined in this way with respect to the rail pressure applied at the moment may be converted to an adaptation value for the PCV characteristic curve and, for example, stored in a control unit.

This method offers the advantage that the proposed function operates in MU mode and at any given rail pressure, while the above-described APCV function, for example, depends on the combination of PCV mode and high rail pressure. In this way an adaptation method for a pressure control valve may be provided using increased learning frequency.

The control current for the pressure control valve is preferably reduced in a modulated manner, for example a sinusoidally or rectangularly modulated manner, the mean control current being reduced. Any periodic modulation is possible in principle. When the mean control current is reduced in a modulated manner, the rail pressure does not respond thereto as long as the value of the closing current is not less than the (rail pressure-dependent) closing current of the PCV. If this value is less than the closing current of the PCV, the PCV opens and the rail pressure starts to fluctuate at the modulation frequency. For evaluation, the rail pressure signal may be analyzed on the basis of the modulation frequency. If there is no response of the rail pressure signal, the valve is completely closed. If, for example, only the lower half-wave of the modulation of the current appears in the rail pressure signal curve, the value of the PCV closing current is in the immediate proximity of the actual current. If the modulation completely appears in the rail pressure signal, the actual current is less than the closing current, and the mean rail pressure drops.

To obtain a particularly accurate determination of the closing current, it is recommended that the phase angle be evaluated in addition to the frequency of the modulation. Due to the inertia of the system, there is a delay in monitoring of the response of the rail pressure to the modulation of the PCV current. This delay is manifested as a constant phase shift, which may additionally be used to suppress the noise of the rail pressure signal (so-called "lock-in" or phase-sensitive detection).

The operation of the common rail injection system in an MU control mode advantageously takes place at high pressures, in particular at a rail pressure greater than 1000 bar, preferably greater than 1500 bar, more preferably greater than 2000 bar. In principle, the desired operating pressure of the injection system is a function of the engine calibration, i.e., the design defaults. The objective of this calibration is usually to achieve the lowest possible emissions, low fuel consumption, etc. The prevailing pressures are a function of the operating point; for example, in idle mode much lower pressures, for example less than 500 bar, are expected.

A computing unit according to the present invention, for example a control unit of a motor vehicle, is set up, in particular by programming, to carry out a method according to the present invention.

The implementation of the method in the form of software is also advantageous, since this allows particularly low costs, in particular when an operating control unit is also used for other functions and therefore is present anyway. Suitable data carriers for providing the computer programs are in particular diskettes, hard drives, flash memories, EEPROMs, CD ROMs, DVDs, and others. Downloading a program via computer networks (Internet, intranet, etc.) is also possible.

DETAILED DESCRIPTION OF THE INVENTION

Figure 1:
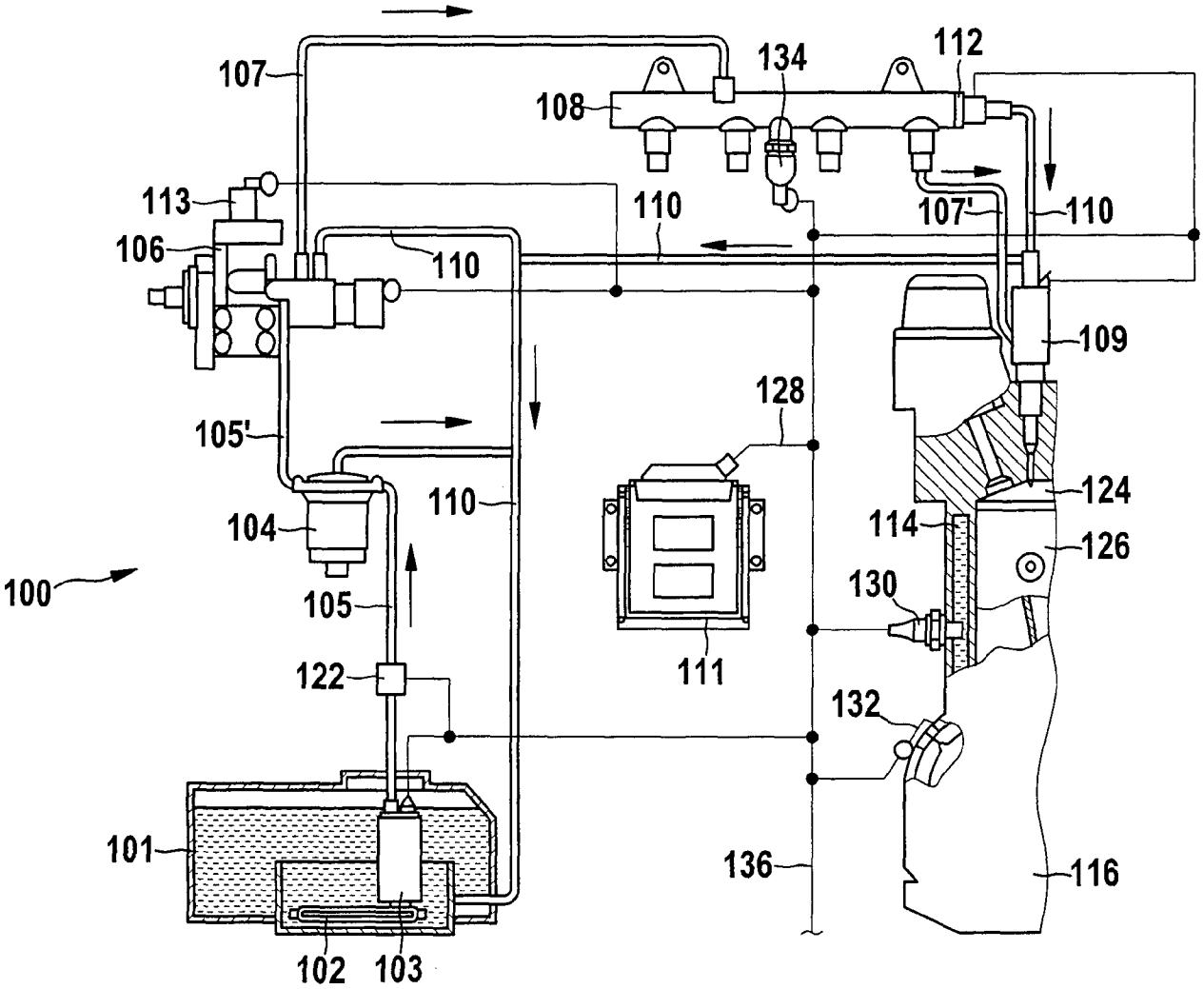
FIG. 1 schematically shows a common rail fuel injection system, on the basis of which one example embodiment of a method according to the present invention is described.

FIG. 1 shows a schematic diagram of a common rail fuel injection system 100 for an internal combustion engine 116, for example a diesel engine. A piston 126 is movably situated in a cylinder 124 of internal combustion engine 116, shown in a partial cutaway view, which is cooled by cooling water 114. An injector 109 for injecting fuel into the cylinder is mounted on cylinder 124.

The fuel injection system includes a fuel tank 101, which is shown in the almost completely full state. Situated inside fuel tank 101 is a prefeed pump 103, which draws fuel from tank 101 through a prefilter 102, and conveys the fuel at a low pressure of 1 bar to 10 bar maximum through a fuel line 105 and to a fuel filter 104. A further low-pressure line 105' leads from fuel filter 104 to a high-pressure pump 106, which compresses the supplied fuel to a high pressure which, depending on the system, is typically between 100 bar and 2000 bar. High-pressure pump 106 feeds the compressed fuel into a high-pressure line 107 and a rail 108 connected thereto. A further high-pressure line 107' leads from rail 108 to injector 109. High-pressure pump 106 has a metering unit (MU) 113.

A system of return lines 110 allows excess fuel from fuel filter 104, high-pressure pump 106 or metering unit 113, injector 109, and rail 108 to return to fuel tank 101. A pressure control valve (PCV) 112 is connected between rail 108 and return line 110 which is able to adjust the high pressure prevailing in rail 108 to a constant value by changing the quantity of fuel flowing from rail 108 into return line 110.

The entire common rail injection system 100 is controlled by a control unit 111 which is connected via electrical lines 128 to prefeed pump 103, high-pressure pump 106, metering unit 113, injector 109, a pressure sensor 134 on rail 108, pressure control valve 112, and temperature sensors 132, 122 at internal combustion engine 116 or at fuel supply line 105. The control unit is connected via a bus system 136 to further control units (not shown), via which the control unit is able to access further data such as the ambient temperature, the travel speed, or the engine rotational speed.

Figure 2:
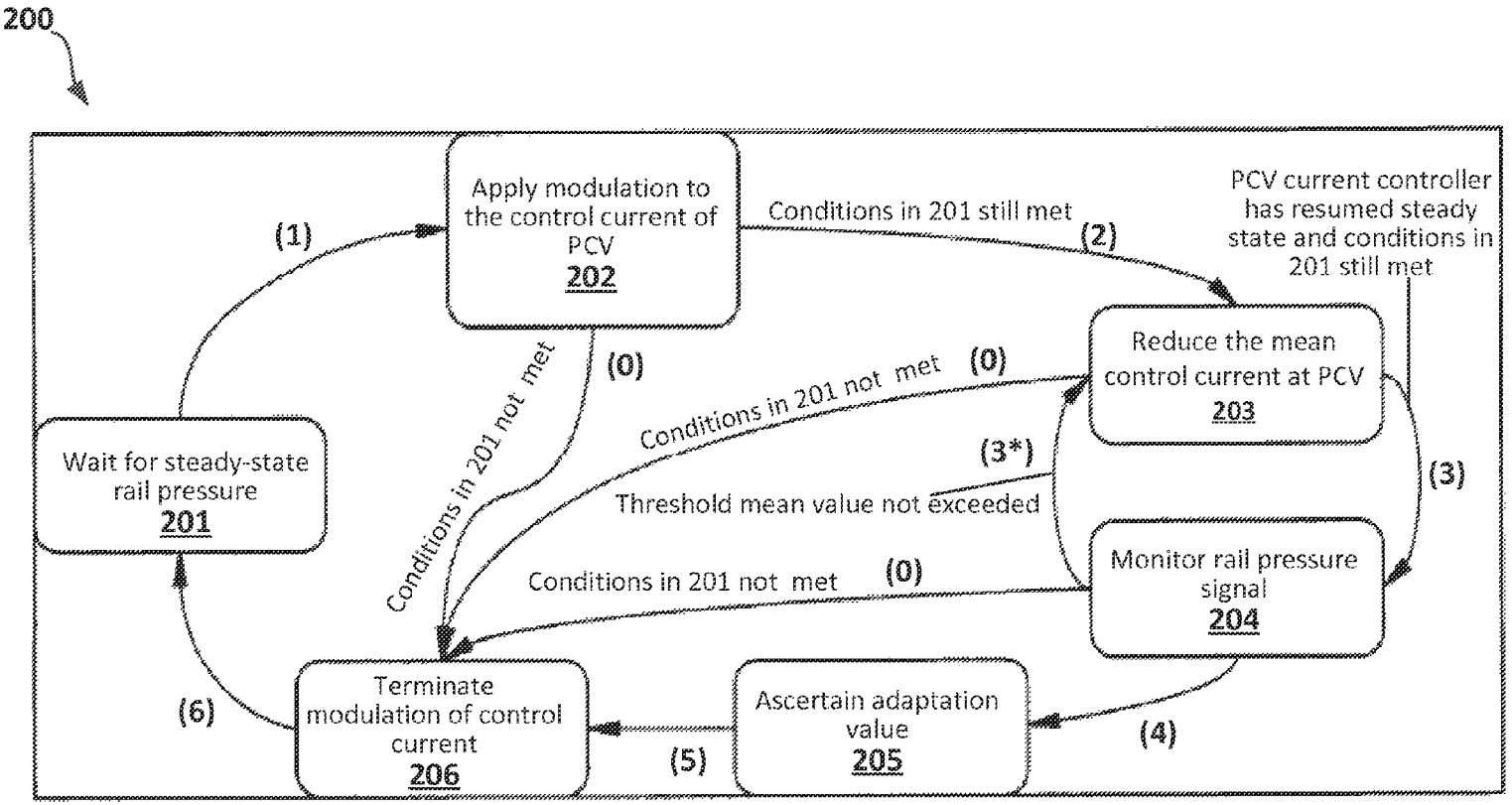
FIG. 2 shows one example embodiment of a method according to the present invention, with reference to a diagram of a state machine.

FIG. 2 illustrates one preferred specific embodiment of a method according to the present invention, with reference to a diagram 200. Diagram 200 shows the sequence of a method according to the present invention, with reference to a state machine.

State 201 denotes the waiting for a steady-state rail pressure. It is advantageous for the sequence of the method if the rail pressure is essentially in a steady state. An absolute steady-state operation, for example of the rotational speed or the injection quantity of the engine, is not necessary in practice, since the pressure control valve is closed at the start of the method, and the MU controller may be operated independently of same. It is sufficient to monitor the maintenance of an allowable pressure window $\pm\Delta p$ for a given time period $\pm\Delta t$. If this condition is met, the system proceeds along (1) to a state 202.

State 202 denotes the application of a modulation. A modulation, which advantageously is periodic, is applied to the control current of the pressure control valve. If, after application of the modulation, the rail pressure still meets the stability conditions according to state 201, a change is made to a state 203 along (2). Otherwise, a transition is made to a state 206 along (0).

State 203 denotes the reduction of the mean control current at the pressure control valve. The setpoint value of the mean control current is reduced, which may be carried out in discrete increments, for example, which may ultimately specify the measuring resolution for the closing current. If the PCV current controller has resumed a stable steady state after the reduction and the conditions according to state 201 are still met, the transition is made along (3) to a state 204. Otherwise, a transition is made to state 206 along (0).

State 204 describes the monitoring of the rail pressure signal. In this state the rail pressure signal is detected with sufficiently high resolution. The rail pressure signal may be evaluated by shifting the detected rail pressure signal into the phase of the modulation signal (or another reference signal having the same frequency) and then multiplying by same. The result no longer shows a change in the algebraic sign, thus allowing a sliding mean value, for example over multiple periods, to be formed. If this mean value exceeds a predefined threshold value, it is recognized that the pressure control valve is open, and the transition is made to a state 205 along (4). If the threshold value is not exceeded, a return is made to state 203 along (3*), thus further reducing the mean control current. If one of the stability criteria according to state 201 is not met during the monitoring of the rail pressure signal in state 204, a transition is made along (0) to state 206. This frequency- and phase-sensitive detection of the modulation in the rail pressure signal contributes significantly to increasing the sensitivity of the method compared to conventional filters, such as band pass filters, for example.

State 205 describes the ascertainment of an adaptation value. For this purpose, the ascertained closing current for an associated rail pressure value may be set in relation to a setpoint current, and a factor or adaptation value may be determined therefrom. An initial PCV characteristic curve may then be scaled using this factor. After the adaptation value is computed, the transition is made along (5) to state 206.

State 206 describes the termination of the method. The modulation of the control current is terminated, and a return is made along (6) to starting state 201.

In the method according to the present invention, it is desirable to determine the closing current at the highest possible rail pressures. For this reason it appears advantageous in state 201 not only to check the stability of the rail pressure, but also to make a request for the rail pressure threshold to be exceeded. This threshold should preferably be raised after a successful learning operation, and, if no successful learning operation has taken place within an applicable period of time, it should be lowered. In this way learning is carried out sufficiently often, and also at the highest possible pressures.

In addition, in state 204, for example, instead of the modulation frequency, which results in the gradient of the rail pressure, the doubled frequency may also be used for phase-sensitive detection. As a result of the above-described averaging process, the second derivative of the rail pressure according to the control current is obtained. Using the doubled frequency provides improved noise suppression. In one alternative embodiment of the method, this allows the characteristic curve of the actuator to be learned in individual segments. This is of particular interest when it is no longer possible to meet the so-called linearity condition for the PCV due to design considerations, for example, or because of production tolerances. It is recommended that current supplied to the PCV be reduced continuously, not in stages, since the gradient of the rail pressure is zero until the valve is opened. At the moment of opening, the rail pressure begins to drop, and the output signal of the above-described method becomes proportional to the gradient of the rail pressure curve plotted against the control current.

Figure 3:
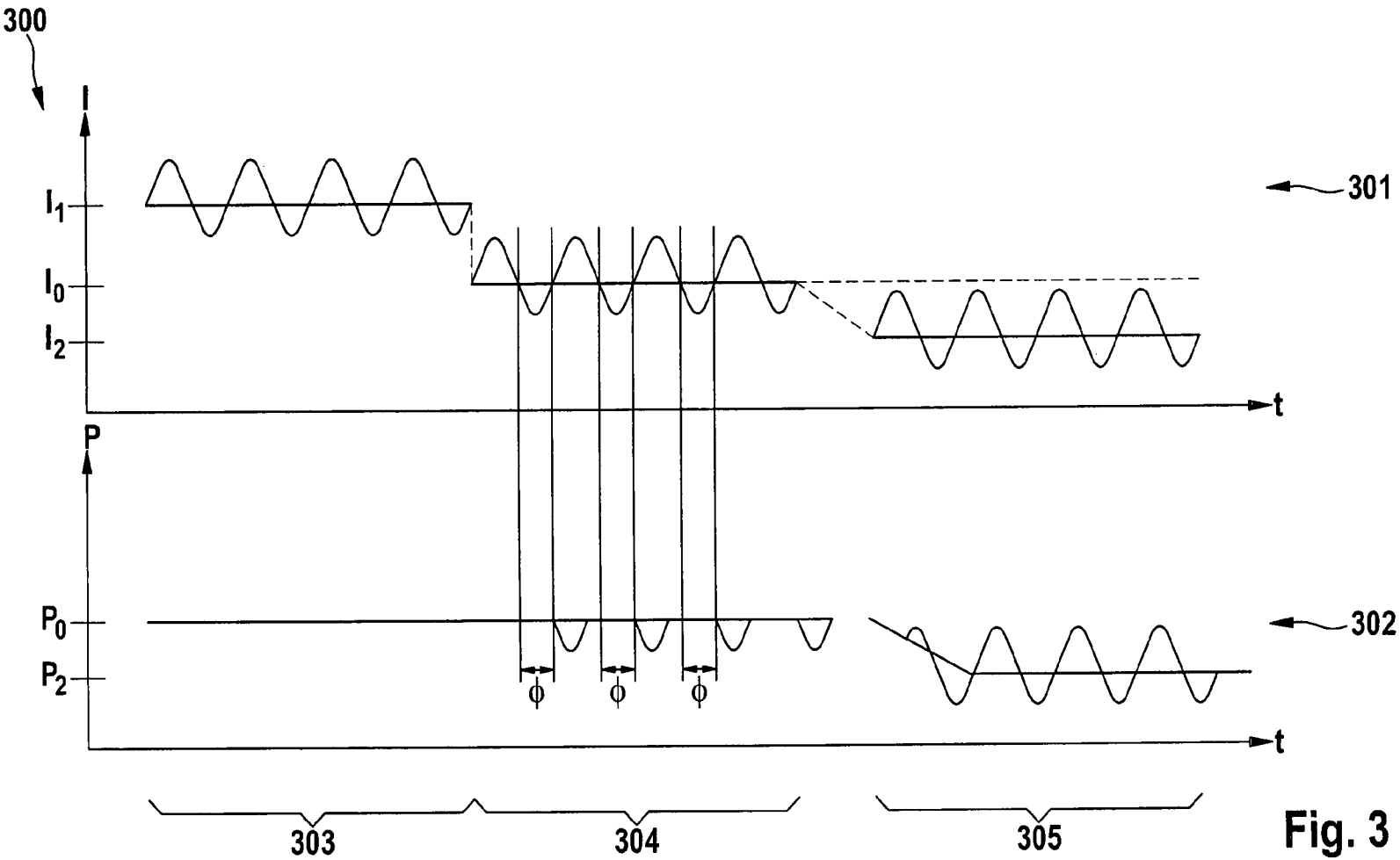
FIG. 3 shows a diagram of the relationship between a detected rail pressure curve and the applied valve current.

FIG. 3 illustrates, with reference to a diagram 300, one possible relationship between a control current curve 301 and a detected rail pressure curve 302. Control current curve I and rail pressure curve P are plotted as a function of time t. Thus, the method begins when a first modulated control current is applied to the pressure control valve in a time period 303, and at the same time the resulting rail pressure in the common rail is detected or measured. No fluctuations in rail pressure curve 302 are discernible in time period 303. Instead, an essentially static rail pressure $P_0$ prevails.

In a subsequent time period 304 the mean control current is reduced, so that a mean control current curve about a mean value $I_0$ is applied to the pressure control valve. At the same time, the rail pressure is once again detected. In time period 304 it is discernible that the rail pressure is periodically dropping, which is caused by the modulation of the control current. A phase shift Φ between the drop in the control current and the associated drop in the rail pressure is measurable as a result of the inertia of the system. This phase shift may be used for improved evaluation of the measurement.

In a subsequent time period 305 the mean control current is reduced further, so that a control current which is modulated about mean value $I_2$ is then present. The modulation, which fluctuates about a rail pressure mean value $P_2$, is likewise clearly discernible in the associated rail pressure curve.

Based on the measured values, a rail pressure/closing current value pair may then be determined for the associated pressure control valve by associating closing current $I_0$ with rail pressure $P_0$.

What is claimed is:

1. A method for determining at least one rail pressure and closing current value pair for a pressure control valve of a common rail injection system of an internal combustion engine, comprising:

operating the common rail injection system in a metering-unit control mode, during which a rail pressure is controlled using a metering-unit valve, the pressure control valve is closed, and the rail pressure is in a steady state;

while in the metering-unit control mode, performing the following:

reducing a control current for the pressure control valve;

detecting a pressure curve over time in the common rail by monitoring the rail pressure;

determining a rail pressure value as corresponding to a point on the detected pressure curve at which a drop in the rail pressure is detected, the drop caused by an opening of the pressure control valve in response to the reducing of the control current; and determining a closing current value corresponding to the rail pressure value; and associating the rail pressure value and the closing current value with the at least one rail pressure and closing current value pair.

2. The method as recited in claim 1, wherein the control current is a periodic signal and the reduction of the control current for the pressure control valve includes modulated reduction of a mean value of the control current.

3. The method as recited in claim 2, wherein the modulated reduction is one of sinusoidally or rectangularly modulated.

4. The method as recited in claim 2, wherein the determination of the rail pressure value is carried out by evaluating at least one of a frequency and a phase angle of the detected pressure curve.

5. The method as recited in claim 2, wherein the operation of the common rail injection system in the metering-unit control mode includes operation in a steady state with regard to at least one of the rotational speed of the internal combustion engine and the injection quantity.

6. The method as recited in claim 2, wherein the operation of the common rail injection system in the metering-unit control mode includes operation at a rail pressure greater than 1000 bar.

7. The method as recited in claim 2, wherein an adaptation value for a characteristic curve of the pressure control valve is determined based on the at least one rail pressure and closing current value pair.

8. The method as recited in claim 7, wherein the adaptation value is stored in a control unit.

9. The method as recited in claim 2, wherein at least a second rail pressure and closing current value pair is determined.

10. The method as recited in claim 9, wherein in the determination of the second rail pressure and closing current value pair, the operation of the common rail injection system in the metering-unit control mode includes operation at a higher steady-state rail pressure than for the determination of the at least one rail pressure and closing current value pair.

11. A non-transitory computer-readable storage medium storing a computer program having program codes which, when executed on a computer, controls a method for determining at least one rail pressure and closing current value pair for a pressure control valve of a common rail injection system of an internal combustion engine, the method comprising:

operating the common rail injection system in a metering-unit control mode, during which a rail pressure is controlled using a metering-unit valve, the pressure control valve is closed, and the rail pressure is in a steady state;

while in the metering-unit control mode, performing the following:

reducing a control current for the pressure control valve;

detecting a pressure curve over time in the common rail by monitoring the rail pressure;

determining a rail pressure value as corresponding to a point on the detected pressure curve at which a drop in the rail pressure is detected, the drop caused by an opening of the pressure control valve in response to the reducing of the control current; and determining a closing current value corresponding to the rail pressure value; and associating the rail pressure value and the closing current value with the at least one rail pressure and closing current value pair.

* * * * *